US006585125B1

(12) United States Patent
Peek

(10) Patent No.: US 6,585,125 B1
(45) Date of Patent: Jul. 1, 2003

(54) HOT FILL CONTAINER WITH VERTICALLY ASYMMETRIC VACUUM PANELS

(75) Inventor: William Jerome Peek, Lithonia, GA (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 10/189,662

(22) Filed: Jul. 3, 2002

(51) Int. Cl.[7] ..... B65D 1/02; B65D 1/42

(52) U.S. Cl. ..... 215/381; 215/382; 220/666; 220/675

(58) Field of Search ..... 215/381, 382, 215/384; 220/609, 666, 669, 675; D9/434, 551, 553, 557

(56) References Cited

U.S. PATENT DOCUMENTS

| | | | | |
|---|---|---|---|---|
| 4,818,575 | A | 4/1989 | Hirata et al. | |
| D315,869 | S | 4/1991 | Collette | |
| 5,005,716 | A | 4/1991 | Eberle | |
| 5,054,632 | A | * 10/1991 | Alberghini et al. | 220/609 X |
| 5,141,120 | A | 8/1992 | Brown et al. | |
| 5,178,289 | A | 1/1993 | Krishnkumar et al. | |
| 5,178,290 | A | 1/1993 | Ota et al. | |
| 5,222,615 | A | * 6/1993 | Ota et al. | 220/675 X |
| 5,341,946 | A | 8/1994 | Vailliencourt et al. | |
| D352,245 | S | 11/1994 | Krishnakumar et al. | |
| 5,381,910 | A | * 1/1995 | Sugiura et al. | 220/675 |
| 5,407,086 | A | 4/1995 | Ota et al. | |
| D382,799 | S | * 8/1997 | Darr | D9/434 |
| 5,735,420 | A | 4/1998 | Nakamaki et al. | |
| D411,453 | S | 6/1999 | Piccioli et al. | |
| 5,908,128 | A | 6/1999 | Krishnakumar et al. | |
| D413,519 | S | 9/1999 | Eberle et al. | |
| D419,882 | S | 2/2000 | Bretz et al. | |
| D420,592 | S | 2/2000 | Bretz et al. | |
| D427,905 | S | 7/2000 | Eberle | |
| D429,647 | S | 8/2000 | Warner et al. | |
| D434,330 | S | 11/2000 | Rowe et al. | |
| D445,334 | S | 7/2001 | Bretz et al. | |
| 6,264,053 | B1 | * 7/2001 | Slat | 215/384 |
| D446,126 | S | 8/2001 | Bretz et al. | |
| 6,347,717 | B1 | 2/2002 | Eberle | |
| 2001/0037992 | A1 | * 11/2001 | Tanabe et al. | |

FOREIGN PATENT DOCUMENTS

| | | | | |
|---|---|---|---|---|
| JP | 405065158 | * 3/1993 | | 220/675 |

* cited by examiner

*Primary Examiner*—Sue A. Weaver
(74) *Attorney, Agent, or Firm*—Brinks Hofer Gilson & Lione

(57) ABSTRACT

A thin walled, plastic hot-fill container has a closable neck, a shoulder portion situated below the neck, a base, and a body portion connecting the shoulder portion to the base. The body portion includes a label mount area bounded by upper and lower margins having a plurality of vacuum panels with vertical land areas separating each adjacent pair of vacuum panels. Each vacuum panel includes an upper area and a lower area, the upper and lower areas of each vacuum panel being mutually asymmetric and connected by a tapering geometry providing a range of pressure response through varying flexibility without significant movement of the components parts of the vacuum panels.

23 Claims, 5 Drawing Sheets

HOT FILL CONTAINER WITH VERTICALLY ASYMMETRIC VACUUM PANELS

BACKGROUND OF THE INVENTION

The present invention relates to blow-molded containers of biaxially oriented thermoplastic materials, typically polyethylene terephthalate, that are especially adapted to be filled with a hot liquid or semi-liquid product and hermetically sealed, and which are generally referred to as thin-walled hot-fill containers. The invention particularly relates to improvements in container design to achieve a filled container that, when cooled, retains a desired container configuration despite the development of a partial vacuum within the container, and provides enhanced support of any label applied to the container even when subjected to sidewall impact.

Thin-wall hot-fill containers are typically used for packaging of liquids which must be placed in the container while hot to provide for adequate sterilization. During the filling process, the container is subjected to elevated temperatures on the order of about 85° C. and may be subjected to some small positive internal pressures on the order of about 0.2 bar. The container is immediately capped so that no appreciable cooling of the container contents occurs prior to the hermitic sealing. As the product subsequently cools, a negative internal pressure is formed in the sealed container. Any flexible wall of the container will elastically deform inward to the extent necessary to at least partially reduce the negative pressure within the container. Thin-wall hot-fill containers of the prior art typically include a plurality of vacuum panels specially designed to elastically deform in a controlled manner, thus preventing any large uncontrolled shape distortion. The vacuum panels are typically arranged around the circumference of a middle portion of the container and are typically covered by a wrap-around label held within the margins of an area commonly identified as the label panel.

Many styles and geometric patterns have been developed for the vacuum panels. The variations are all intended to address various concerns about the container performance and shape retention when dropped, when vertically stacked, when pinched by manually gripping the container, etc. To address these concerns the vacuum panels often include raised central wall portions, post areas between the vacuum panels, and circumferential land areas above and below the vacuum panels, longitudinal and circumferential recessed ribs, hinge portions, etc. As the wall thickness of the containers is reduced from the already thin dimension of typically less than ½ mm, the various problems associated with thin-wall hot-fill containers become exacerbated. A particularly difficult problem is presented by side impacts that tend to permanently deform the sidewall of the container. A more general problem is the competing desires of providing sufficient stiffness in specific areas of the label panel, while still permitting other areas to yield in the intended manner for successful hot-fill performance.

What is needed is a thin wall hot-fill container that provides a large range of flexibility while retaining sufficient support of any label applied to the container even when subjected to sidewall impact.

SUMMARY OF THE INVENTION

These competing needs are satisfied by a container of the present invention, which has a closable neck, a shoulder portion situated below the neck, a base, and a body portion connecting the shoulder portion to the base. The body portion includes a label mount area bounded by upper and lower margins. A plurality of vacuum panels are situated in the label mount area with a land area separating each adjacent pair of vacuum panels. Each of the vacuum panels includes an upper edge and a lower edge, each edge being spaced from the upper and lower margins of the label mount area. Each vacuum panel includes an upper area adjacent the upper edge and a lower area adjacent the lower edge, the upper and flower areas of each vacuum panel being mutually asymmetric. As an example, either the upper or lower area of each vacuum panel comprises a horizontally cylindrically concave surface while the other area of each vacuum panel comprises a plane inclined at a shallow angle with respect to a horizontal plane. Additionally, the label mount area includes a circumferential recessed rib located in the land area adjacent to the margin of the label mount area nearest to the end of the vacuum panel including the horizontally cylindrically concave surface.

Each of the vacuum panels of a thin-walled hot-fill plastic container of the present invention includes a central portion joining the upper area and the lower area, the central portion preferably including a central land area and side portions coupling the central land area to the adjacent land areas separating adjacent vacuum panels from each other. In a preferred embodiment, the side portions of each vacuum panel include a tapered geometry from the upper area to the lower area. The tapered geometry can comprise, for example, a conical surface section of decreasing radius of curvature from the upper area to the lower area.

The tapered geometry and the differences between the upper and lower areas evokes a vertically asymmetric pattern to the vacuum panels that achieves a large range of pressure response through varying flexibility without significant movement of the components parts of the vacuum panels. The shallow angled portion at one end of the vacuum panels and the circumferential recessed rib located adjacent to the other end of the vacuum panels provide the required stiffness to resist all but the most significant sidewall impacts, thereby ensuring both the necessary performance and appearance of the container within the margins of the label mount area.

Other features of thin-walled hot-fill containers of the present invention and the corresponding advantages of those features will be come apparent from the following discussion of a preferred embodiment of the present invention, exemplifying the best mode of practicing the present invention, which is illustrated in the accompanying drawings.

DESCRIPTION OF PREFERRED EMBODIMENTS

Figure 1:
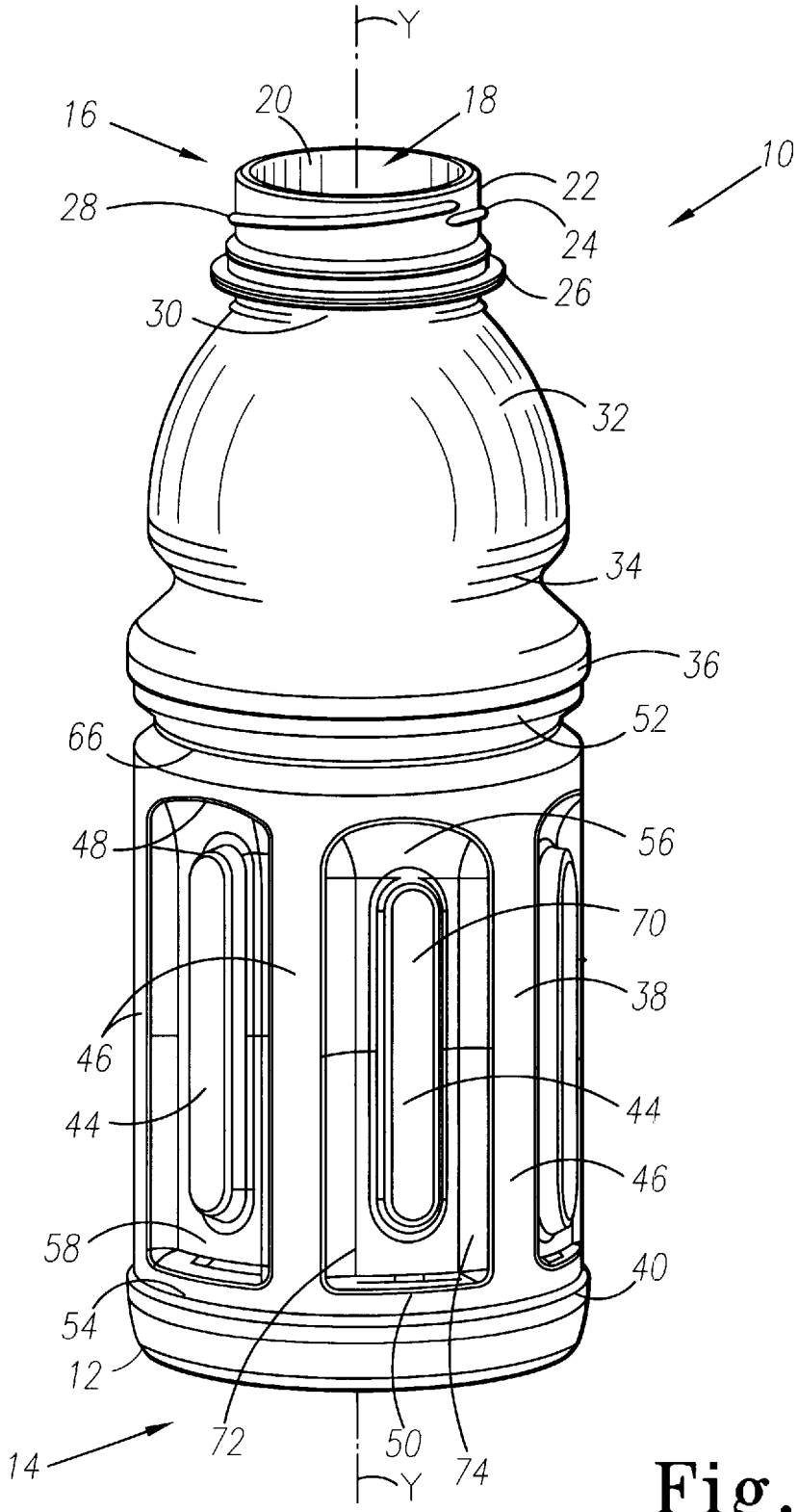
FIG. 1 is a perspective view of a thin-walled hot-fill container of the present invention.
Figure 2:
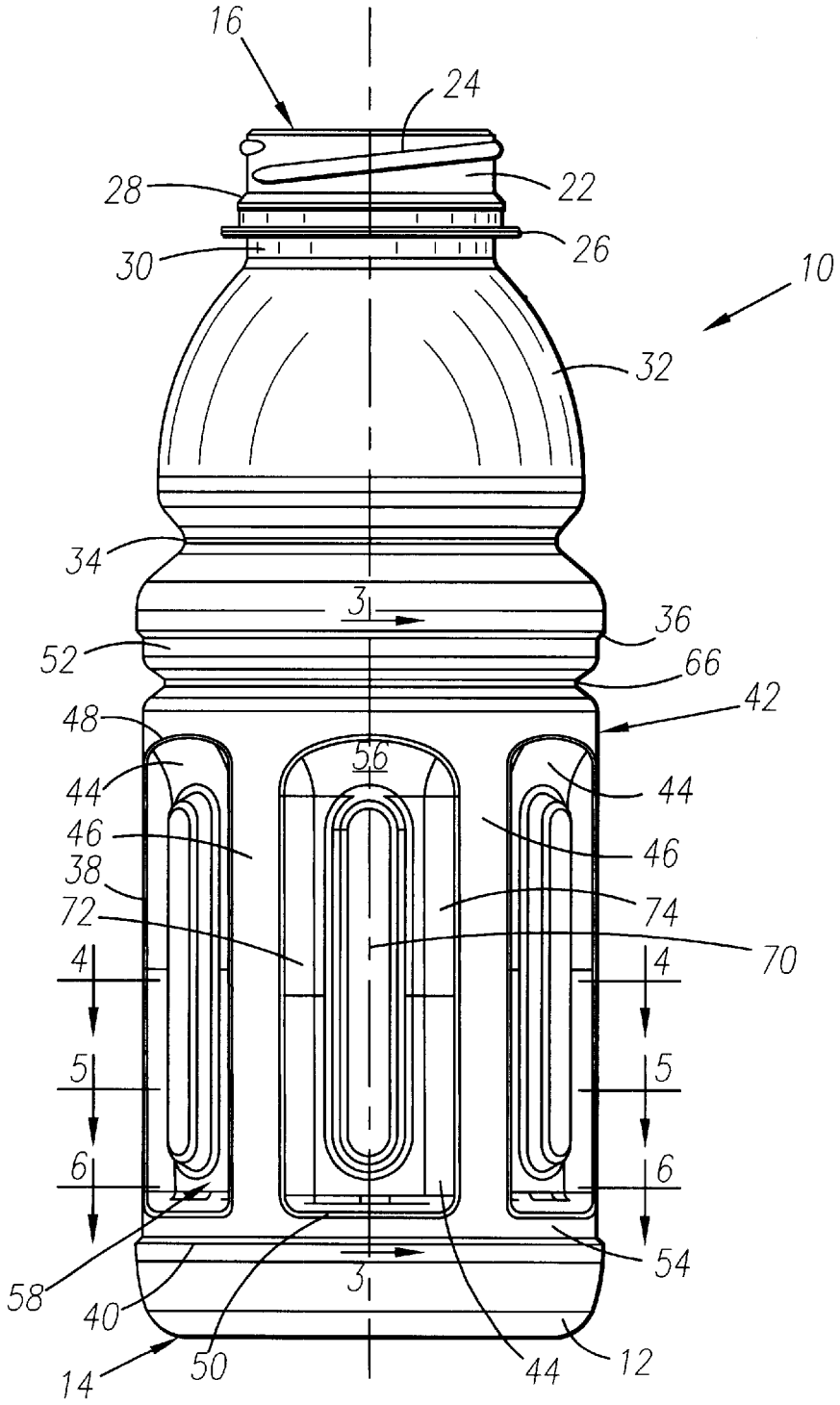
FIG. 2 is a side elevation view of the container shown in FIG. 1.

A thin-walled hot-fill container 10 of the present invention is shown in FIGS. 1 and 2 to include a base 12 on a lower end 14 for generally supporting the container on any underlying substrate such as a shelf or table. An upper end 16 of the container 10 includes an open, mouth 18 leading to the interior 20 of the container 10. The mouth 18 is surrounded by a finish 22, which is shown to include a thread 24 for receiving a threaded cap, not shown. A support ring 26 is located at a lower margin of the finish 22, and a pilfer indicating band engagement ring 28 is located just above the support ring 26. A neck portion 30 is located immediately below the support ring 26. A shoulder portion 32 including a manual grip indention 34 is unitarily joined to the neck portion 30. The shoulder portion 32 is joined by margin 36 to a side wall portion 38 that extends from the should portion 32 down to another margin 40 joining the side wall portion 38 to the base 12. The base 12, margins 36 and 40, shoulder portion 32, neck portion 30, and elements of the finish 22 are rotationally symmetric about the axis Y extending vertically through the center of the container 10.

The side wall portion 38 includes a label mount area 42 bounded by the upper margin 36 and the lower margin 40. A plurality of generally vertically oriented, parallel vacuum panels 44, are situated in the label mount area 42 with a vertical land area 46 separating each adjacent pair of vacuum panels 44. An upper edge 48 and a lower edge 50 define the vertical ends of each of the vacuum panels 44. The upper edge 48 is spaced from the upper margin 36 by a circumferential land portion 52. Similarly, the lower edge 50 is spaced from the lower margin 40 by a circumferential land portion 54. The upper and lower lands 52 and 54 are of equal radius R from the axis Y, and can be employed to receive an adhesive for bonding a label within the margins 36 and 40 of the label mount area 42. The upper and lower lands 52 and 54, taken together with the vertical lands 46, form a continuous surface. The vertical land area 46 provided between each pair of adjacent vacuum panels 44 can include stiffening ribs, not shown. An indented ring 66 is situated between the upper margin 36 of the label mount area 42 and the upper edge 48 of the vacuum panels 44.

Figure 3:
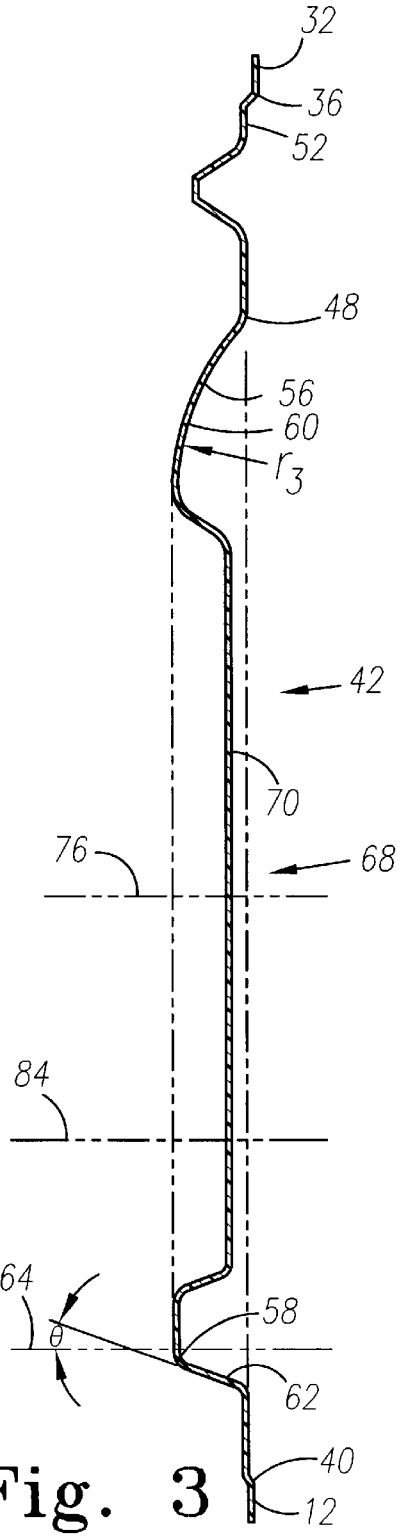
FIG. 3 is a dead vertical sectional view of a vacuum panel of the container shown in FIG. 2 taken along the line 3—3.
Figure 4:
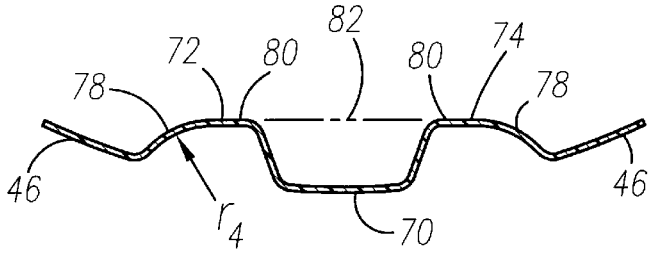
FIG. 4 is a dead horizontal sectional view of a vacuum panel of the container shown in FIG. 2 taken along the line 4—4.
Figure 5:
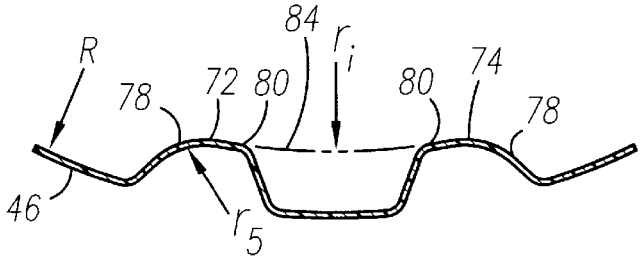
FIG. 5 is a dead horizontal sectional view of a vacuum panel of the container shown in FIG. 2 taken along the line 5—5.
Figure 6:
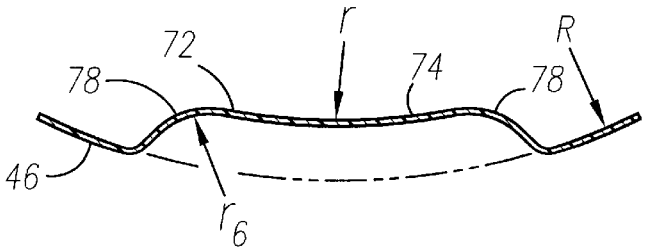
FIG. 6 is a dead horizontal sectional view of a vacuum panel of the container shown in FIG. 2 taken along the line 6—6.

The configuration of the vacuum panels 44 is shown in greater detail in FIGS. 3–6. The vacuum panels 44 are generally identical to each other and include an upper area 56 adjacent the upper edge 48 and a lower area 58 adjacent the lower edge 50. The upper area 56 and lower area 58 of each vacuum panel 44 are configured so as to be mutually asymmetric. In the first preferred embodiment shown in FIGS. 1 and 2, the upper area 56 of each vacuum panel 44 comprises a horizontally cylindrically concave surface 60 of radius $r_3$. On the other hand, the lower area 58 of each vacuum panel 44 comprises an inclined plane 62 that is inclined at a shallow angle θ with respect to a horizontal plane symbolized in FIG. 3 by line 64, the plane being normal to the axis of symmetry Y of the container 10. Each vacuum panel 44 includes a central portion 68 joining the upper area 56 and lower area 58 together. The central portion 68 is shown to include a central land area 70, which can be omitted, and side portions 72 and 74 coupling the central land area 70 to the adjacent vertical land areas 46. The side portions 72 and 74 of each vacuum panel 44 exhibit a tapered geometry from the upper area 56 to the lower area 58 as shown in FIGS. 4–6.

FIG. 4 is a dead horizontal sectional view of a vacuum panel 44 of the container 10 taken along the line 4—4 of FIG. 2, which corresponds to line 76 in FIG. 3. At this height, which is about mid-way between the upper area 56 and the lower area 58, the vacuum panel 44 includes the central land 70 and side portions 72 and 74. The outer margins 78 of portions 72 and 74 are defined by a radius $r_4$, while the inner margins 80 of portions 72 and 74 are defined by a nearly planar segment suggested by line 82.

FIG. 5 is a dead horizontal sectional view of a vacuum panel 44 of the container 10 taken along the line 5—5 of FIG. 2, which corresponds to line 84 in FIG. 3. At this height, which is about mid-way between the line 76 and the line 64, the vacuum panel 44 still includes the central land 70 and side portions 72 and 74. The outer margins 78 of portions 72 and 74 are now defined by a radius $r_5$, which is smaller than radius $r_4$, while the inner margins 80 of portions 72 and 74 are defined by a curve suggested by line 84 having an inside radius $r_i$, that is larger than the defining radius R of the lands 46, 52 and 54.

FIG. 6 is a dead horizontal sectional view of a vacuum panel 44 of the container 10 taken along the line 6—6 of FIG. 2, which corresponds to line 64 in FIG. 3. At this height, which is near the bottom of lower area 58, the vacuum panel 44 no longer includes the central land 70, and side portions 72 and 74 are joined together and defined by radius r, which is smaller than the defining radius R of the lands 46, 52 and 54. Additionally the defining radius $r_6$ of outer margins 78 are reduced further. Thus the overall geometry of the side portions 72 and 74 tapers from the upper area 56 to the lower area 58. The inner margins 80 of the side portions exhibit decreasing radius of curvature from the upper area 56 to said lower area 58, while the outer margins 78 exhibit also generally exhibit a decreasing radius, but of a clearly different value.

Figure 7:
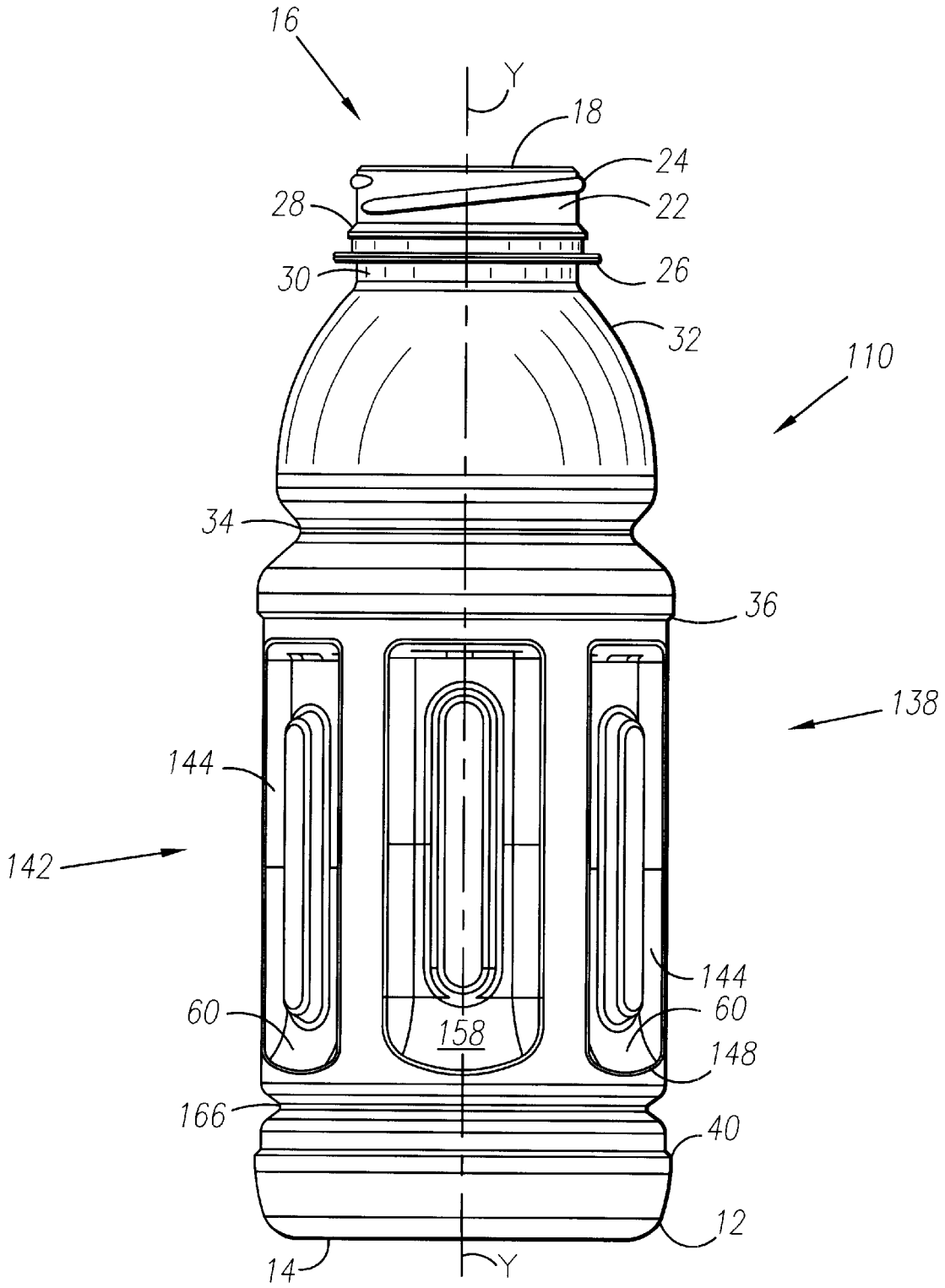
FIG. 7 is a side elevation view of another thin-walled hot-fill container of the present invention.

In the container 10 shown in FIGS. 1 and 2, the horizontally cylindrically concave surfaces 60 of the vacuum panels 44 are all located in the upper area 56. Further, the indented ring 66 is situated in the label mount area 42 between the upper end 48 of the vacuum panel 44, which contain the cylindrically concave surfaces 60, and the upper margin 36 of the label mount area 42. FIG. 7 shows another embodiment of the present invention in which container 110 still includes a base 12 on a lower end 14. The upper end 16 of the container 110 includes a mouth 18 surrounded by a finish 22, which includes a thread 24 for receiving a threaded cap, not shown. A support ring 26 is located at a lower margin of the finish 22, and an engagement ring 28 is located just above the support ring 26. A neck portion 30 is located immediately below the support ring 26. A shoulder portion 32 including a manual grip indention 34 is unitarily joined to the neck portion 30. The shoulder portion 32 is joined by upper margin 36 to a side wall portion 138 that extends from the should portion 32 down to a lower margin 40 joining the side wall portion 138 to the base 12. The side wall portion 138 includes a label mount area 142 bounded by the upper margin 36 and the lower margin 40. A plurality of generally vertically oriented, parallel vacuum panels 144, which are substantially merely vertical inversions of vacuum panels 44 shown in FIGS. 1 and 2, are situated in the label mount area 142. Further, an indented ring 166 is situated between the lower margin 40 of the label mount area 142 and the lower edge 148 of the vacuum panels 144. In the container 110, the indented ring 166 is situated adjacent to the portion of the vacuum panels 144 containing the horizontally cylindrically concave surfaces 60, which are located in the lower area 158 of the vacuum panels 144.

Figure 8:
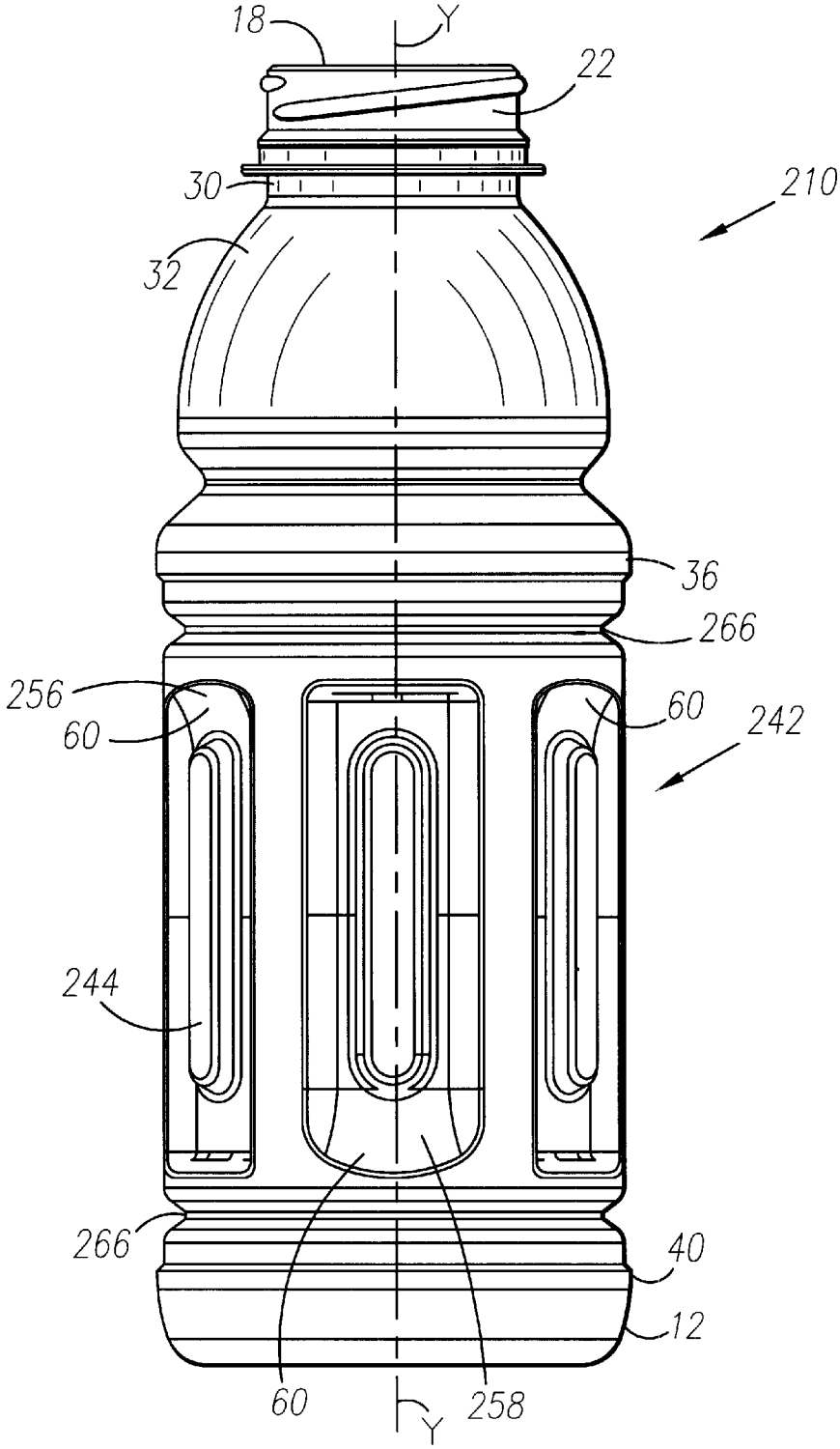
FIG. 8 is a side elevation view of still another thin-walled hot-fill container of the present invention.

Another embodiment of the present invention is shown in FIG. 8 in which a container 210 has an overall structure similar to the embodiments shown in FIGS. 1, 2 and 7, except in the area of the label mount area 242. In container 210, the vacuum panels 244 are each of a design similar to that of vacuum panels 44, however, the vacuum panels 244 can be seen to be arranged in a vertically alternating pattern. This vertically alternating pattern locates the horizontally cylindrically concave surfaces 60 in the upper areas 256 of some vacuum panels 244 and in the lower areas 258 of other vacuum panels 244. The container 210 also includes a pair of indented rings 266 situated adjacent to both ends of the vacuum panels 244. In all the embodiments of the present invention, each of the vacuum panels 44, 144 and 244 are vertically asymmetric and exhibit a tapering geometry from the upper area to the lower area, which achieves a range of pressure response through varying flexibility without significant movement of the components parts of the vacuum panels. The shallow angled portion at one end of the vacuum panels and the circumferential recessed rib located adjacent to the other end of the vacuum panels provide the required stiffness to resist all but the most significant sidewall impacts, thereby ensuring both the necessary performance and appearance of the container within the margins of the label mount area. Other vertically asymmetric arrangements of elements within the vacuum panels are possible, which are likely to also exhibit some range of pressure response, and the particular elements disclosed in the illustrated embodiments are not required for all vertically asymmetric arrangements.

While these features have been disclosed in connection with the illustrated preferred embodiments, other embodiments of the invention will be apparent to those skilled in the art that come within the spirit of the invention as defined in the following claims.

What is claimed is:

1. A thin walled, plastic container for containing a liquid filled initially in a hot state and then sealed, the container having a longitudinal axis and comprising: a closable neck, a shoulder portion situated below the neck, a base, and a body portion connecting the shoulder portion to the base, the body portion including upper and lower margins defining a label mount area between the margins, the label mount area including a plurality of vacuum panels, each adjacent pair of vacuum panels being spaced apart from each other by a first land area, each vacuum panel including an upper edge and a lower edge spaced from the upper and lower margins of the label mount area, each vacuum panel including an upper area adjacent the upper edge and a lower area adjacent the lower edge, the upper and lower areas being asymmetric with respect to each other, the lower area of each vacuum panel comprising a plane inclined at a shallow angle with respect to a plane normal to the container longitudinal axis.

2. The plastic container of claim 1 wherein each vacuum panel includes a central portion joining said upper area and said lower area, the central portion including a central land area and side portions coupling the central land area to said adjacent first land areas.

3. The plastic container of claim 2 wherein the side portions of each vacuum panel include a tapered geometry from said upper area to said lower area.

4. The plastic container of claim 3 wherein the tapered geometry comprises a conical surface section of decreasing radius of curvature from said upper area to said lower area.

5. The plastic container of claim 1 wherein the upper area of each vacuum panel comprises a horizontally cylindrically concave surface.

6. The plastic container of claim 1 wherein the label mount area includes an indented ring situated between the upper margin of the label mount area and the upper edge of the vacuum panels.

7. The plastic container of claim 1 wherein the vacuum panels are vertically elongated and arrayed parallel to each other in the label mount area.

8. The plastic container of claim 1 wherein the upper area of all the vacuum panels are identical to each other.

9. A thin walled, plastic container for containing a liquid filled initially in a hot state and then sealed, the container having a longitudinal axis and comprising: a closable neck, a shoulder portion situated below the neck, a base, and a body portion connecting the shoulder portion to the base, the body portion including a label mount area bounded by upper and lower margins, a plurality of vacuum panels situated in the label mount area, a first land area separating each adjacent pair of vacuum panels, each vacuum panel including an upper edge and a lower edge spaced from the upper and lower margins of the label mount area, each vacuum panel including an upper area adjacent the upper edge and a lower area adjacent the lower edge, the upper and lower areas of each vacuum panel being mutually asymmetric one of the upper and lower areas of each vacuum panel comprising a horizontally cylindrically concave surface while another of the upper and lower areas of each vacuum panel comprises a plane inclined at a shallow angle with respect to a plane normal to the container longitudinal axis.

10. The plastic container of claim 9 wherein the horizontally cylindrically concave surfaces of the vacuum panels are all located at common ends if the vacuum panels.

11. The plastic container of claim 10 further comprising an indented ring situated in the label mount area between the end of the vacuum panels containing said cylindrically concave surfaces and the closer adjacent margin of the label mount area.

12. The plastic container of claim 11 wherein the indented ring is situated adjacent to the upper margin of the label mount area, and the cylindrically concave surfaces are located in the upper end of each of the vacuum panels.

13. The plastic container of claim 12 wherein a central portion of each vacuum panel joins said upper area and said lower area, the central portion including side portions coupling the central area of each vacuum panel to said adjacent first land areas.

14. The plastic container of claim 13 wherein the side portions of each vacuum panel comprises a tapered geometry from said upper area to said lower area.

15. The plastic container of claim 14 wherein the tapered geometry comprises a conical surface section of decreasing radius of curvature from said upper area to said lower area.

16. A thin walled, plastic container for containing a liquid filled initially in a hot state and then sealed, the container having a longitudinal axis and comprising: a closable neck, a shoulder portion situated below the neck, a base, and a body portion connecting the shoulder portion to the base, the body portion including a label mount area bounded by upper and lower margins, a plurality of vacuum panels situated in the label mount area, a first land area separating each adjacent pair of vacuum panels, each vacuum panel including an upper edge and a lower edge spaced from the upper and lower margins of the label mount area, each vacuum panel including an upper area adjacent the upper edge and a lower area adjacent the lower edge, the upper and lower areas of each vacuum panel being mutually asymmetric wherein side portions of each vacuum panel include a tapered geometry from the upper area to the lower area, one of the upper and lower areas of all vacuum panels comprising a horizontally cylindrically concave surface, the label mount area further including an indented ring situated between the end of the vacuum panels containing the cylindrically concave surfaces and the closer adjacent margin of the label mount area.

17. The plastic container of claim 16 wherein the indented ring is situated adjacent to the upper margin of the label mount area.

18. A thin walled, plastic container for containing a liquid filled initially in a hot state and then sealed, the container having a longitudinal axis and comprising: a closable neck, a shoulder portion situated below the neck, a base, and a body portion connecting the shoulder portion to the base, the body portion including upper and lower margins defining a label mount area between the margins, the label mount area including a plurality of vacuum panels, each adjacent pair of vacuum panels being spaced apart from each other by a first land area, each vacuum panel including an upper edge and a lower edge spaced from the upper and lower margins of the label mount area, each vacuum panel including an upper area adjacent the upper edge and a lower area adjacent the lower edge, a central portion joining the upper area and the lower area, the central portion including a central land area and side portions coupling the central land area to the adjacent first land areas, the upper and lower areas being asymmetric with respect to each other, and the side portions of each vacuum panel including a tapered geometry from the upper area to the lower area.

19. The plastic container of claim 18 wherein the tapered geometry comprises a conical surface section of decreasing radius of curvature from said upper area to said lower area.

20. The plastic container of claim 18 wherein the upper area of each vacuum panel comprises a horizontally cylindrically concave surface.

21. The plastic container of claim 18 wherein the label mount area includes an indented ring situated between the upper margin of the label mount area and the upper edge of the vacuum panels.

22. The plastic container of claim 18 wherein the vacuum panels are vertically elongated and arrayed parallel to each other in the label mount area.

23. The plastic container of claim 18 wherein the upper area of all the vacuum panels are identical to each other.

* * * * *